US008315406B2

(12) United States Patent
Kon

(10) Patent No.: US 8,315,406 B2
(45) Date of Patent: Nov. 20, 2012

(54) MUSIC REPRODUCING SYSTEM AND INFORMATION PROCESSING METHOD

(75) Inventor: Homare Kon, Tokyo (JP)

(73) Assignee: Sony Corporation, Tokyo (JP)

( * ) Notice: Subject to any disclaimer, the term of this patent is extended or adjusted under 35 U.S.C. 154(b) by 316 days.

(21) Appl. No.: 12/629,166

(22) Filed: Dec. 2, 2009

(65) Prior Publication Data

US 2010/0142720 A1 Jun. 10, 2010

(30) Foreign Application Priority Data

Dec. 4, 2008 (JP) ..... 2008-309270

(51) Int. Cl.

| | |
|---|---|
| ***H04R 1/10*** | (2006.01) |
| ***H04R 29/00*** | (2006.01) |
| ***H04R 1/02*** | (2006.01) |
| ***H04R 9/06*** | (2006.01) |

(52) U.S. Cl. ..... 381/74; 381/58; 381/59; 381/334

(58) Field of Classification Search ..... 381/74, 381/58, 59, 334

See application file for complete search history.

(56) References Cited

U.S. PATENT DOCUMENTS

| | | | | |
|---|---|---|---|---|
| 2007/0060446 | A1 | 3/2007 | Asukai et al. | |
| 2009/0105548 | A1 * | 4/2009 | Bart | 600/300 |

FOREIGN PATENT DOCUMENTS

| | | | |
|---|---|---|---|
| EP | 0 762 803 | A2 | 3/1997 |
| JP | 08-195997 | A | 7/1996 |
| JP | 09-070094 | A | 3/1997 |
| JP | 2000-310993 | A | 11/2000 |
| JP | 2001-299980 | A | 10/2001 |
| JP | 2002-009918 | A | 1/2002 |
| JP | 2005-072867 | A | 3/2005 |
| JP | 2006-119178 | | 5/2006 |
| JP | 2006-146980 | | 6/2006 |
| JP | 2006-304052 | A | 11/2006 |
| JP | 2007-075172 | A | 3/2007 |
| JP | 2007-150733 | A | 6/2007 |
| JP | 2007-167472 | | 7/2007 |
| JP | 2008-136556 | A | 6/2008 |
| JP | 2008-289033 | A | 11/2008 |
| JP | 2008-289101 | A | 11/2008 |
| WO | WO 95-10167 | | 4/1995 |
| WO | WO 2007/110807 | A2 | 10/2007 |

* cited by examiner

*Primary Examiner* — Xu Mei

*Assistant Examiner* — Douglas Suthers

(74) *Attorney, Agent, or Firm* — Wolf, Greenfield & Sacks, P.C.

(57) ABSTRACT

A music reproducing system has a music reproducing unit and a transducer unit connected to the music reproducing unit. The transducer unit includes a transducer, a main sensor, and attachment-state detector. The music reproducing unit includes an information processing part and a detection controller.

11 Claims, 14 Drawing Sheets

MUSIC REPRODUCING SYSTEM AND INFORMATION PROCESSING METHOD

BACKGROUND OF THE INVENTION

1. Field of the Invention

The present invention relates to a music reproducing system including a music reproducing unit and a transducer unit connected thereto, such as an earphone unit or a headphone unit, and also to an information processing method applied to the music reproducing unit of the music reproducing system.

2. Description of the Related Art

In recent years, people often use a music reproducing unit, such as a portable music player, and earphones or headphones to listen to music while, for example, moving.

In the related art, when a listener listens to music by using earphones or headphones, the motion or biometric state of the listener is detected and information processing for reproduction of music is performed in accordance with the detection result.

Japanese Unexamined Patent Application Publications Nos. 9-70094 and 11-205892 describe the technique of detecting rotation of the head of a listener, and controlling sound-image localization according to the detection result, thereby localizing a sound image at a position defined outside the head of the listener.

Japanese Unexamined Patent Application Publications Nos. 2006-119178 and 2006-146980 describe, for example, the technique of recommending a musical piece to a listener according to a biometric state of the listener, such as pulse and perspiration.

Japanese Unexamined Patent Application Publication No. 2007-244495 describes the method of accurately detecting a motion of a user in a vertical direction by using an acceleration sensor without being affected by noise.

Japanese Unexamined Patent Application Publication No. 2005-72867 describes the method of performing on/off control over a power supply or the like based on a detection output from a touch sensor mounted on an earphone.

However, the following problems arise when information processing regarding reproduction of music is performed by using a motion sensor, such as a gyro sensor or an acceleration sensor, or a biometric sensor, such as a pulse sensor or a sweat sensor, mounted on an earphone, for example.

When the rotation of the head of the listener is detected for sound-image localization, a wrong output may be produced from the sensors at the time of attaching or reattaching the earphones. For this reason, after attachment of the earphones is completed, it may be difficult to localize a sound image, or the sound image is localized at a significantly displaced position.

For example, when a musical piece is selected in accordance with an output from a pulse sensor and is presented to the listener as a recommended musical piece, if the earphones are reattached, an instantaneous rapid pulse may be detected, resulting in selection of a musical piece that may not match the actual mood of the listener.

For example, when a traveling pace is detected by an acceleration sensor to control the tempo of a musical piece being reproduced in accordance with the traveling pace, a wrong traveling pace may be detected while the listener reattaches the earphones, resulting in a mismatch between the tempo of the musical piece being reproduced and the actual traveling pace.

To get around the above, a reset key is provided to a music reproducing unit. When the listener performs a rest operation immediately after attaching or reattaching the earphones, settings and parameters for processing, such as sound-image localization, are reset.

FIG. 15 depicts a series of operations in the above case to be performed by the listener when initially attaching the earphones.

When the listener initially attaches the earphones, the listener first picks up the earphones at step 211, and then attaches the earphones to his or her ears at step 212.

Next, at step 213, the listener releases his or her hands from the earphones after insertion (attachment) is complete. Next, at step 214, the listener resets the settings and parameters for processing, such as sound-image localization.

FIG. 16 depicts a series of operations to be performed by the listener when reattaching the earphones attached as described above.

When reattaching the earphones, the listener starts from step 221.

Next, at step 222, the listener releases his or her hands from the earphones after insertion (reattachment) is complete. Next, at step 223, the listener resets the settings and parameters for processing, such as sound-image localization.

SUMMARY OF THE INVENTION

However, it may be bothersome for the listener to reset the settings and parameters for processing, such as sound-image localization, every time the listener attaches and reattaches the earphones.

Moreover, for example, in sound-image localization, if the listener moves his or her head to try to perform a reset operation, the settings and parameters may become incorrect.

It is desirable to eliminate a reset operation, and to correctly perform processing, such as sound-image localization, upon completion of attachment or reattachment of earphones or headphones, even without a reset operation by the listener.

A music reproducing system according to an embodiment of the present invention includes a music reproducing unit, and a transducer unit connected to the music reproducing unit, the transducer unit including a transducer converting an audio signal to audio, a main sensor detecting a motion state or a biometric state of a listener to which the transducer unit is attached, and attachment-state detecting means for producing an output value that changes between a first value and a second value on the basis of whether the listener makes contact with the transducer unit, and the music reproducing unit including an information processing part performing information processing regarding reproduction of music according to an output signal from the main sensor, and a detection controller determining from the output value from the attachment-state detecting means whether the transducer unit is in an ongoing-attachment state, in which the transducer unit is being attached or reattached to the listener, or in an attachment-complete state, in which the transducer unit has been attached to the listener, making the output signal from the main sensor ineffective or suppressing the output signal during a period in which the transducer unit is determined as being in the ongoing-attachment state, and canceling ineffectiveness or suppression when the transducer unit is determined as being in the attachment-complete state.

In the above-structured music reproducing system according to an embodiment of the present invention, during a period determined as being in the ongoing-attachment state, the output signal from the main sensor embodied by a motion sensor or a biometric sensor is made ineffective or suppressed. When the state is determined as the attachment-complete state, this ineffectiveness or suppression is cancelled.

Therefore, in the attachment-complete state, in which the earphones or headphones have been attached, a wrong process based on a wrong sensor output at the time of attaching or reattaching the earphones or headphones is not performed in sound-image localization and musical-piece selection.

According to the embodiment of the present invention, it is possible to eliminate a reset operation, and to correctly perform processing, such as sound-image localization, upon completion of attachment or reattachment of earphones or headphones, even without a reset operation by the listener.

DESCRIPTION OF THE PREFERRED EMBODIMENTS

1. System Structure

FIGS. 1 to 4

1-1. External Structure of the System

FIG. 1

Figure 1:
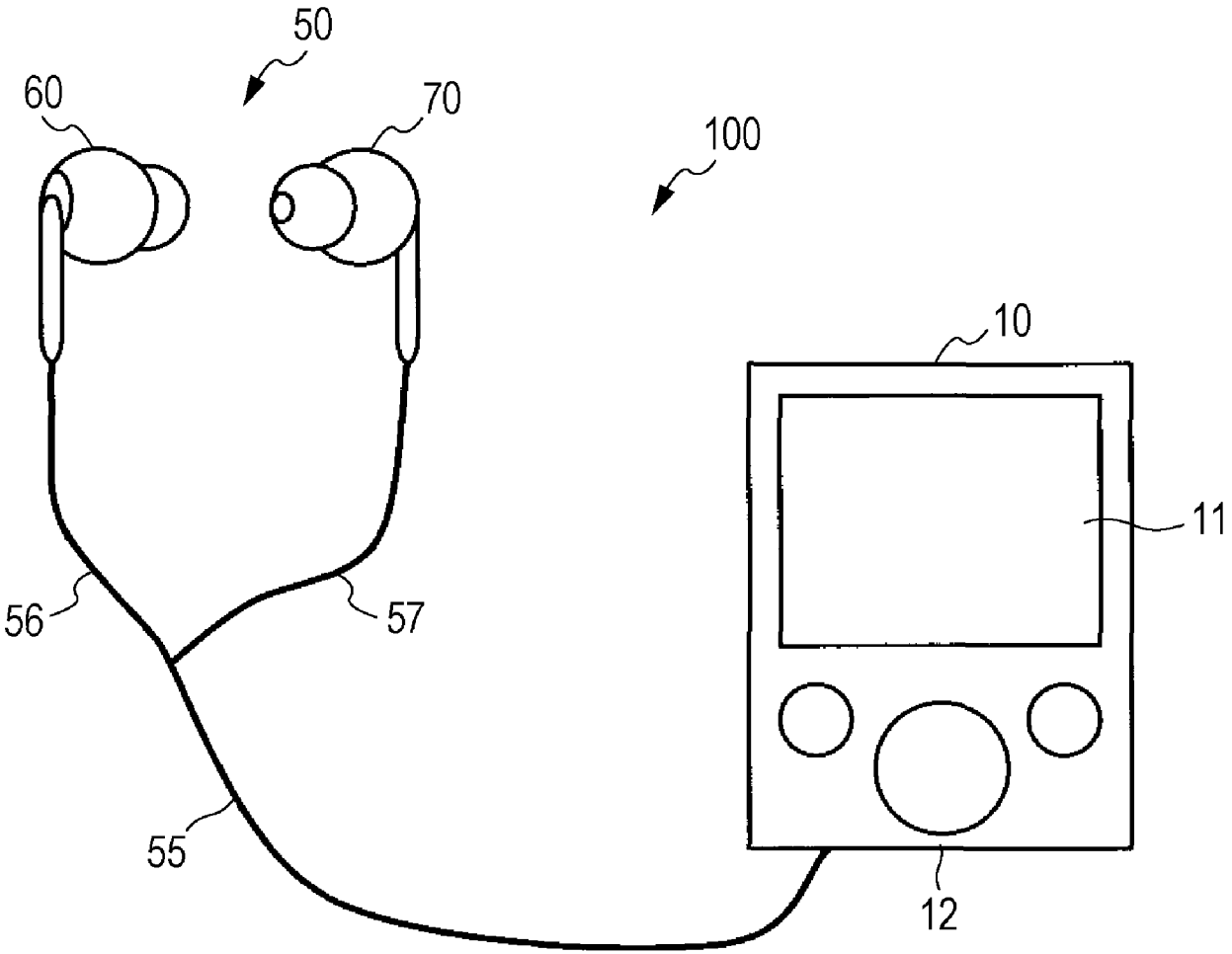
FIG. 1 depicts the external structure of an exemplary music reproducing system according to an embodiment of the present invention.

FIG. 1 depicts the external structure of an exemplary music reproducing system according to an embodiment of the present invention.

A music reproducing system 100 of this example includes a music reproducing unit 10 and an earphone unit 50.

In this example, as a portable music player, the music reproducing unit 10 includes, when externally viewed, a display 11, such as a liquid crystal display or an organic EL display, and an operation part 12, such as operation keys or an operation dial.

The earphone unit 50 includes a left earphone part 60, a right earphone part 70, and a cord 55. Cord portions 56 and 57 are branched from one end of the cord 55 and connected to the left earphone part 60 and the right earphone part 70.

Although not shown in FIG. 1, a plug is connected to the other end of the cord 55. With this plug inserted into a jack provided to the music reproducing unit 10, the earphone unit 50 is connected to the music reproducing unit 10 in a wired manner.

1-2. Earphone Unit

FIG. 2

Figure 2:
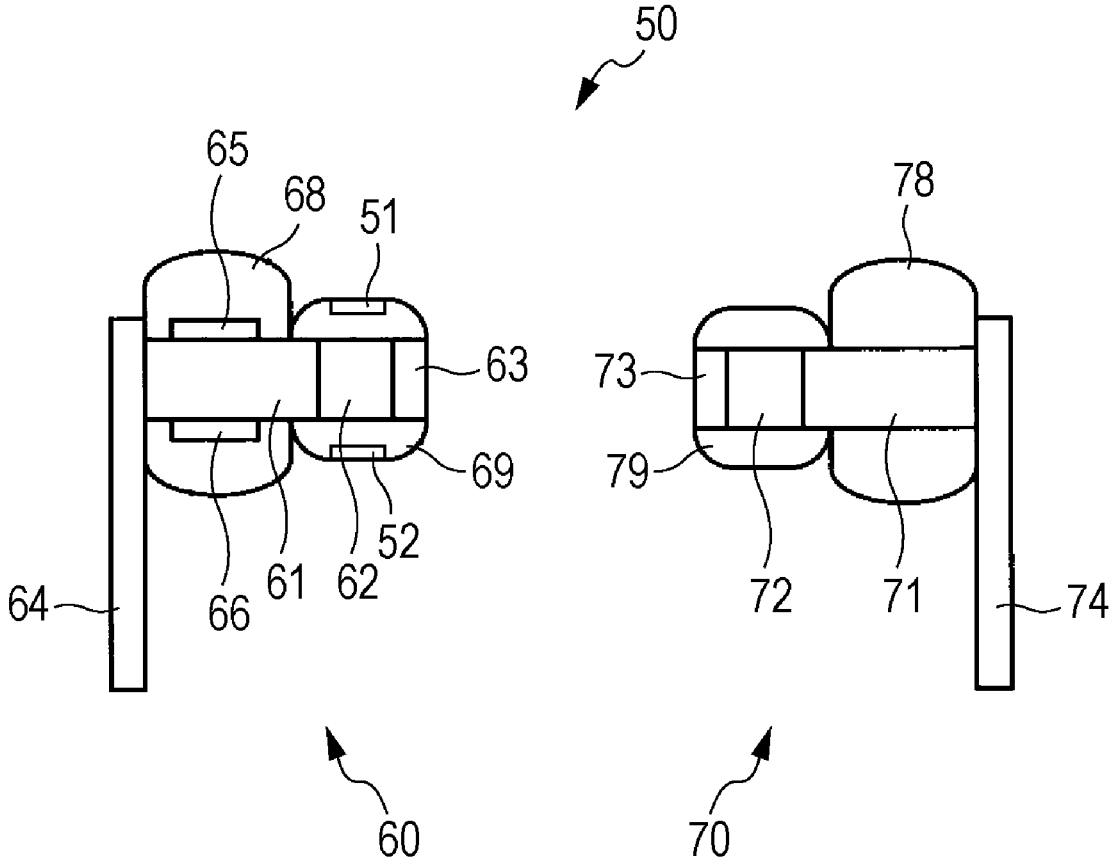
FIG. 2 depicts an exemplary earphone unit.

FIG. 2 depicts details of the left earphone part 60 and the right earphone part 70.

The left earphone part 60 includes an inner frame 61, on which a transducer 62 and a grille 63 are mounted on one end, and a cord bushing 64 is mounted on the other end. The transducer 62 converts an audio signal to audio.

A gyro sensor 65 and an acceleration sensor 66, each functioning as one type of motion sensor, as well as a touch-sensor-equipped housing 68 are attached on a portion, of the left earphone part 60, which is outside the ear.

A pulse sensor 51 and a sweat sensor 52, each functioning as one type of biometric sensor, as well as an ear piece 69 are mounted on a portion, of the left earphone part 60, which is inside the ear.

As with the left earphone part 60, the right earphone part 70 includes an inner frame 71, on which a transducer 72 and a grille 73 are mounted on one end, and a cord bushing 74 is mounted on the other end.

A touch-sensor-equipped housing 78 is mounted on a portion, of the right earphone part 70, which is outside the ear. An ear piece 79 is mounted on a portion, of the right earphone part 70, which is inside the ear.

1-3. Connection Structure of the System

FIG. 3

Figure 3:
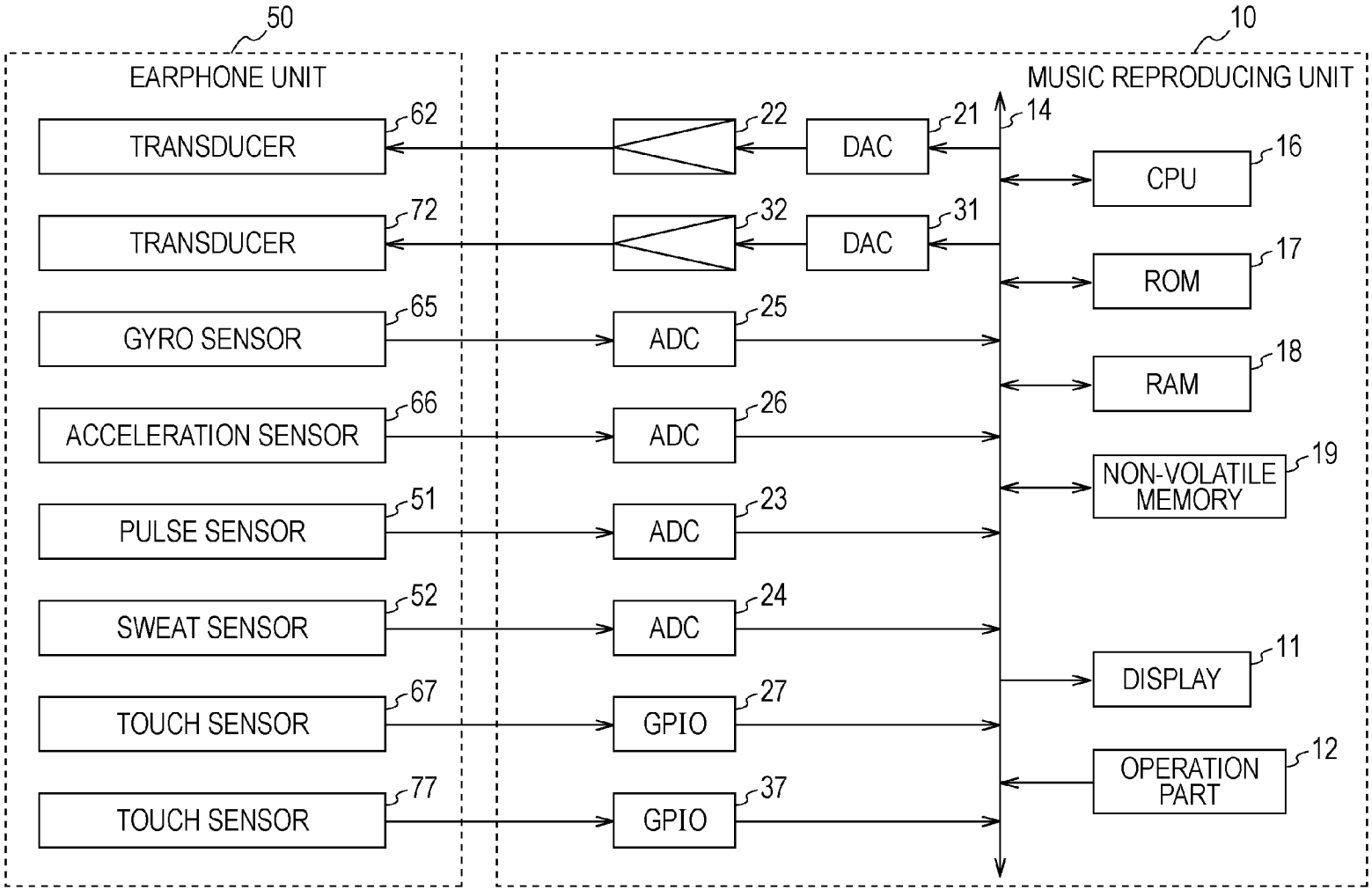
FIG. 3 depicts connection of the components of the exemplary music reproducing system according to the embodiment of the present invention.

FIG. 3 shows connection of the components of the music reproducing system 100.

The music reproducing unit 10 has a bus 14, to which, in addition to the display 11 and the operation part 12, a central processing unit (CPU) 16, a read only memory (ROM) 17, a random access memory (RAM) 18, and a non-volatile memory 19 are connected.

In the ROM 17, various programs to be executed by the CPU 16 and necessary fixed data are written in advance. The RAM 18 functions as, for example, a work area for the CPU 16.

The non-volatile memory 19 is incorporated or inserted in the music reproducing unit 10, and has music data and image data recorded.

Digital to analog converters (DACs) 21 and 31, audio amplifier circuits 22 and 32, analog to digital converters (ADCs) 23, 24, 25, and 26, and general-purpose input/output (GPIO) interfaces 27 and 37 are connected to the bus 14.

Left and right digital audio data of music data is converted by the DACs 21 and 31 to analog audio signals. These converted left and right audio signals are respectively amplified by the audio amplifier circuits 22 and 32 and supplied to the transducers 62 and 72 of the earphone unit 50.

Output signals from the gyro sensor 65 and the acceleration sensor 66, each functioning as a motion sensor, are respectively converted by the ADCs 25 and 26 to digital data, which is then sent to the bus 14.

Output signals from the pulse sensor 51 and the sweat sensor 52, each functioning as a biometric sensor, are respectively converted by the ADCs 23 and 24 to digital data, which is then sent to the bus 14.

Output voltages of touch sensors 67 and 77 mounted on the touch-sensor-equipped housings 68 and 78 depicted in FIG. 2 are respectively converted by the GPIO interfaces 27 and 37 to digital data, which is then sent to the bus 14.

1-4. Functional Structure of the System

FIG. 4

Figure 4:
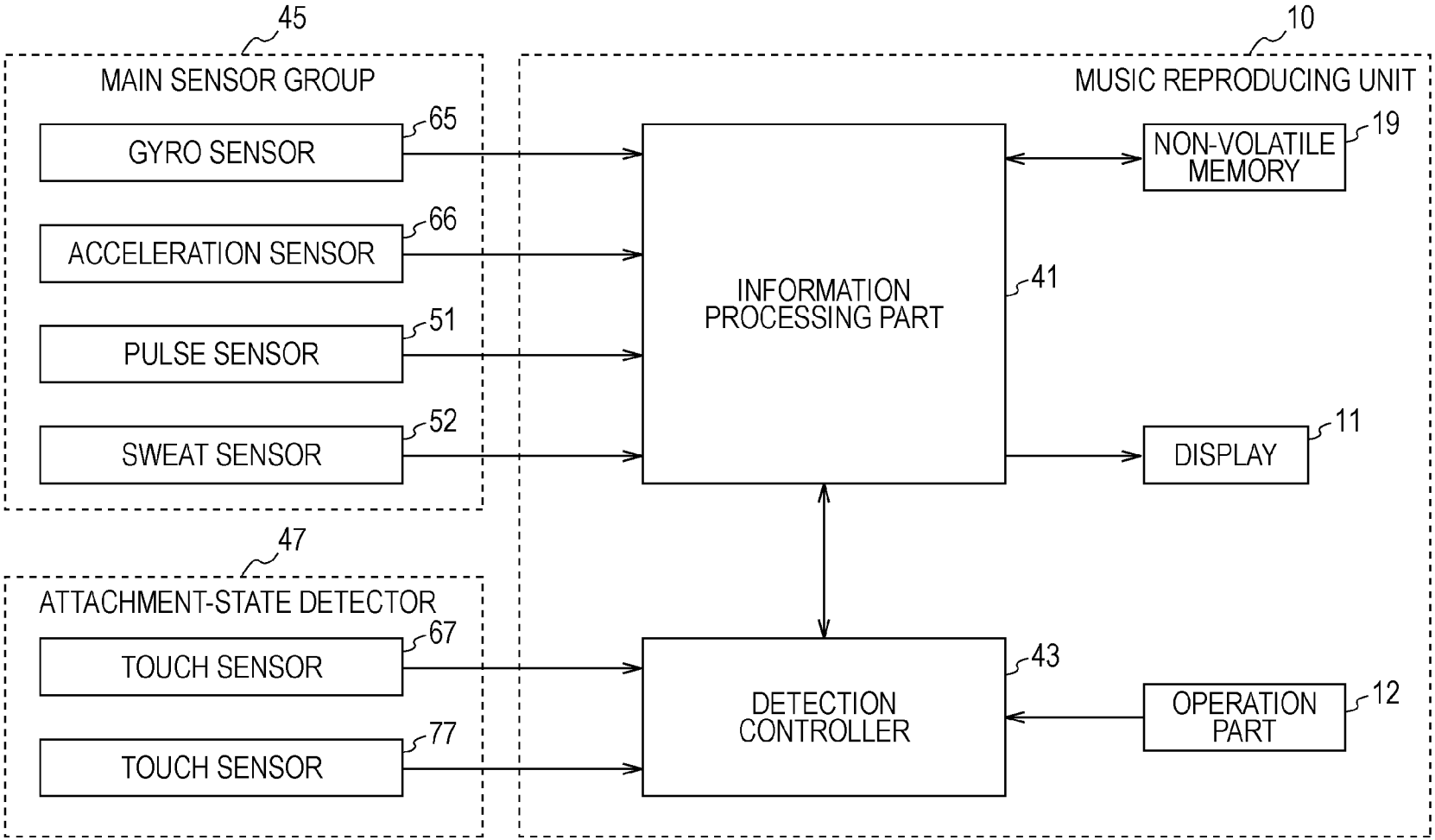
FIG. 4 is a functional block diagram of the exemplary music reproducing system according to the embodiment of the present invention.

The music reproducing unit 10 is functionally configured to have an information processing part 41 and a detection controller 43 as depicted in FIG. 4.

The information processing part 41 includes, in terms of hardware, the CPU 16, the ROM 17, the RAM 18, and the ADCs 23, 24, 25, and 26 depicted in FIG. 3.

The detection controller 43 includes, in terms of hardware, the CPU 16, the ROM 17, the RAM 18, and the GPIO interfaces 27 and 37.

As will be described further below, according to output signals from one or more of the gyro sensor 65, the acceleration sensor 66, the pulse sensor 51, and the sweat sensor 52 configuring a main sensor group 45, the information processing part 41 performs information processing regarding reproduction of music, such as sound-image localization, selection of a musical piece, and control over a music reproduction state.

For example, as for sound-image localization, data of a musical piece to be reproduced is read from the non-volatile memory 19 and captured into the information processing part 41, where sound-image localization is performed in accordance with an output signal from the gyro sensor 65, as will be described further below.

When a motion picture, a still picture, or a screen, such as a screen for operation or presentation, is displayed on the display 11 in relation to or irrespectively of reproduction of music, information processing regarding that image or screen is also performed at the information processing part 41.

As will be described further below, the detection controller 43 detects and determines from output voltages of the touch sensors 67 and 77 configuring an attachment-state detector 47 whether the earphone unit 50 is in an ongoing-attachment state or an attachment-complete state.

Furthermore, according to the detection determination result, the detection controller 43 controls information processing regarding reproduction of music at the information processing part 41 as will be described further below.

2. Detection of Earphone Attachment State

FIG. 5

The detection controller 43 in the music reproducing unit 10 detects and determines whether the earphone unit 50 is in the ongoing-attachment state or attachment-complete state as described below.

Figure 5:
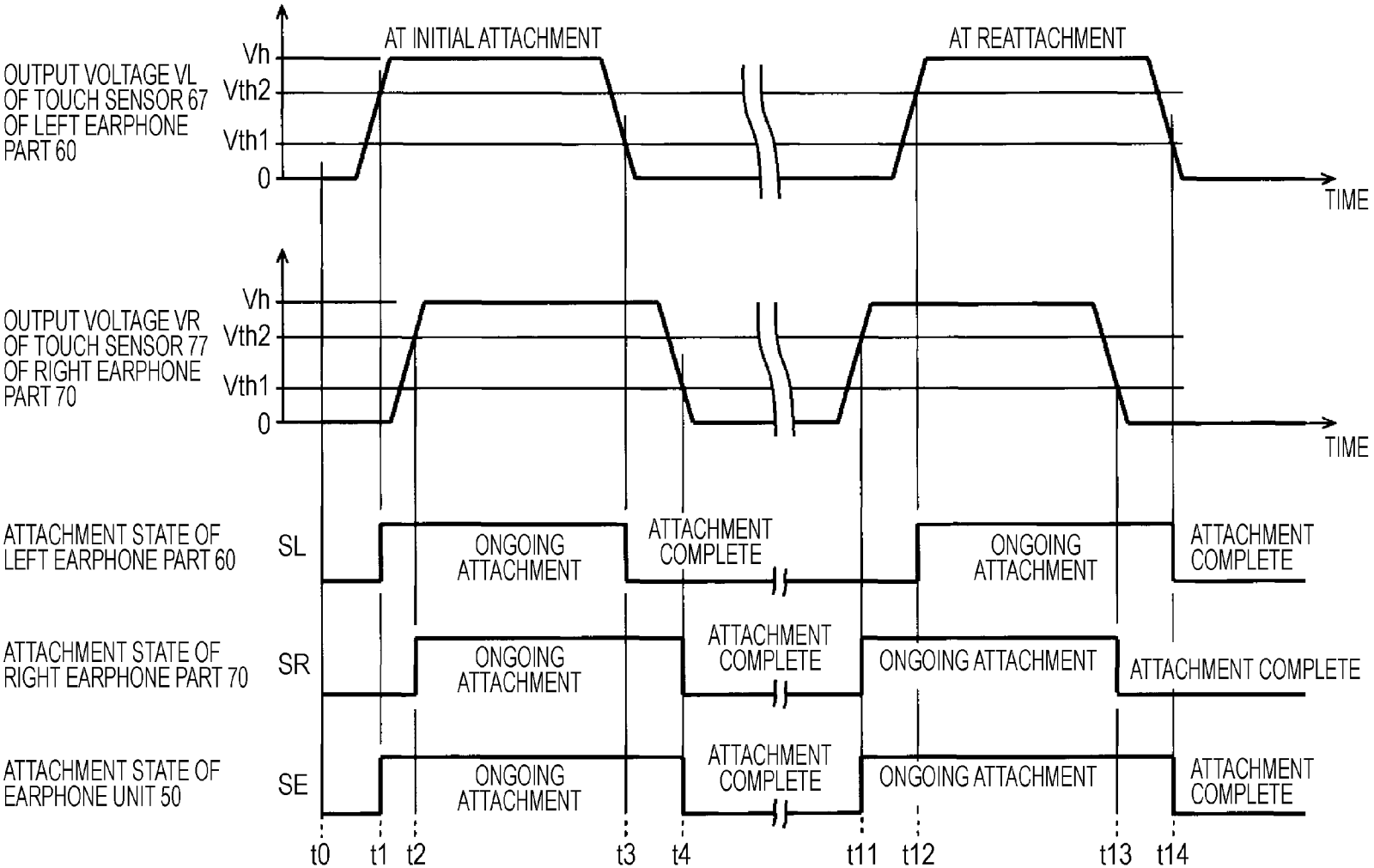
FIG. 5 illustrates detection of an earphone attachment state.

FIG. 5 depicts an example of temporal changes in an output voltage VL of the touch sensor 67 and an output voltage VR of the touch sensor 77.

The output voltage VL of the touch sensor 67 is 0 (ground potential) when a listener does not touch the touch sensor 67 with his or her hand at all. When the listener touches the touch sensor 67 with his or her hand, the output voltage VL changes between 0 and the maximum value Vh in accordance with its contact pressure.

Therefore, when the listener attaches the left earphone part 60 to the left ear or reattaches the left earphone part 60 attached to the left ear, the output voltage VL rises from 0 to the maximum value Vh, and then falls from the maximum value Vh to 0.

This is also true for the output voltage VR of the touch sensor 77 mounted on the right earphone part 70.

At a time t0, a power supply of the music reproducing unit 10 is turned on, and the music reproducing unit 10 is in an operation start state, but neither left earphone part 60 nor the right earphone part 70 is attached.

FIG. 5 depicts a case in which, from the state described above, the listener attaches the left earphone part 60 and the right earphone part 70 to the ears and, furthermore, for example, in this state, the listener selects a musical piece and reattaches the left earphone part 60 and the right earphone part 70 while listening to the musical piece.

Furthermore, FIG. 5 depicts a case in which the output voltage VL of the touch sensor 67 first changes at initial attachment before a change of the output voltage VR of the touch sensor 77. Conversely, the output voltage VR of the touch sensor 77 first changes at reattachment before a change of the output voltage VL of the touch sensor 67.

In this case, in the detection controller 43 in the music reproducing unit 10, signals as depicted in FIG. 5 are obtained as a signal SL indicative of an attachment state of the left earphone part 60 and a signal SR indicative of an attachment state of the right earphone part 70.

In FIG. 5, the threshold Vth1 is assumed to be closer to 0, and the threshold Vth2 is assumed to be closer to the maximum value Vh.

A direction in which the output voltage of the touch sensor is changed from 0 to the maximum value Vh is assumed to be a rising direction. Conversely, a direction in which the output voltage is changed from the maximum value Vh to 0 is assumed to be a falling direction.

At initial attachment, when the output voltage VL becomes higher than the threshold Vth2 in the rising direction at a time t1, the level of the signal SL reverses from a low level to a high level. When the output voltage VL becomes lower than the threshold Vth1 in the falling direction at a time t3, the level of the signal SL reverses from a high level to a low level.

Similarly, when the output voltage VR becomes higher than the threshold Vth2 in the rising direction at a time t2, the level of the signal SR reverses from a low level to a high level. When the output voltage VR becomes lower than the threshold Vth1 in the falling direction at a time t4, the level of the signal SR reverses from a high level to a low level.

At reattachment, when the output voltage VR becomes higher than the threshold Vth2 in the rising direction at a time t11, the level of the signal SR reverses from a low level to a high level. When the output voltage VR becomes lower than the threshold Vth1 in the falling direction at a time t13, the level of the signal SR reverses from a high level to a low level.

Similarly, when the output voltage VL becomes higher than the threshold Vth2 in the rising direction at a time t12, the level of the signal SL reverses from a low level to a high level. When the output voltage VL becomes lower than the threshold Vth1 in the falling direction at a time t14, the level of the signal SL reverses from a high level to a low level.

The detection controller 43 in the music reproducing unit 10 determines a period in which the signal SL is at a high level as being in a state in which the left earphone part 60 is being attached or reattached to an ear of the listener.

Similarly, the detection controller 43 determines a period in which the signal SR is at a high level as being in a state in which the right earphone part 70 is being attached or reattached to an ear of the listener.

A period in which the signal SL is at a low level is determined as being in a state immediately after the operation of the music reproducing device 10 starts operation without the left earphone part 60 being attached at all yet, or in a state in which attachment of the left earphone part 60 has been completed.

Similarly, a period in which the signal SR is at a low level is determined as being in a state immediately after the operation of the music reproducing device 10 starts operation without the right earphone part 70 being attached at all yet, or in a state in which attachment of the right earphone part 70 has been completed.

In this manner, by using these high and low thresholds to detect an attachment state, whether the state is the ongoing-attachment state can be reliably and stably determined, compared with a case in which whether the state is the ongoing-attachment state is determined in accordance with whether the output voltage of the touch sensor exceeds a predetermined threshold.

In this case, as a signal indicative of an attachment state of the earphone unit 50, a signal SE as depicted in FIG. 5 is detected.

The signal SE reverses to a high level at the rising edge of the signal SL or SR, whichever reverses to a high level earlier, and also reverses to a low level at the falling edge of the signal SL or SR whichever reverses to a low level later.

Eventually it is determined from this signal SE whether the earphone unit 50 is in the ongoing-attachment state or an attachment-complete state.

In FIG. 5, the signal SE is at a high level during a period from the time t1 to the time t4 and a period from the time t11 to the time t14. Eventually, the period from the time t1 to the time t4 and the period from the time t11 to the time t14 are determined as being in the ongoing-attachment state.

Accordingly, the attachment state of the earphone unit 50 can be appropriately detected even when the timing of attaching or reattaching the left earphone part 60 and the timing of attaching or reattaching the right earphone part 70 do not match, as depicted in FIG. 5.

For example, when the left earphone part 60 is reattached but the right earphone part 70 is not reattached, at the time of or after the reattachment of the left earphone part 60, the output voltage VR of the touch sensor 77 is 0, the signal SR becomes at a low level, and the signal SL itself serves as the signal SE.

In FIG. 5, for convenience, the voltages and signals are analog voltages or binary signals, but these voltages and signals are processed as digital data.

3. Information Processing Regarding Reproduction of Music and Control Over Information Processing FIGS. 6 to 14A and 14B According to the detection determination result described above, the detection controller 43 in the music reproducing unit 10 further controls information processing regarding reproduction of music at the information processing part 41 as described below.

The information processing regarding reproduction of music includes sound-image localization, selection of a musical piece, and control over a reproduction state of a musical piece being reproduced, as will be described further below.

3-1. Process According to the Detection Determination Result of the Attachment State

FIG. 6

Figure 6:
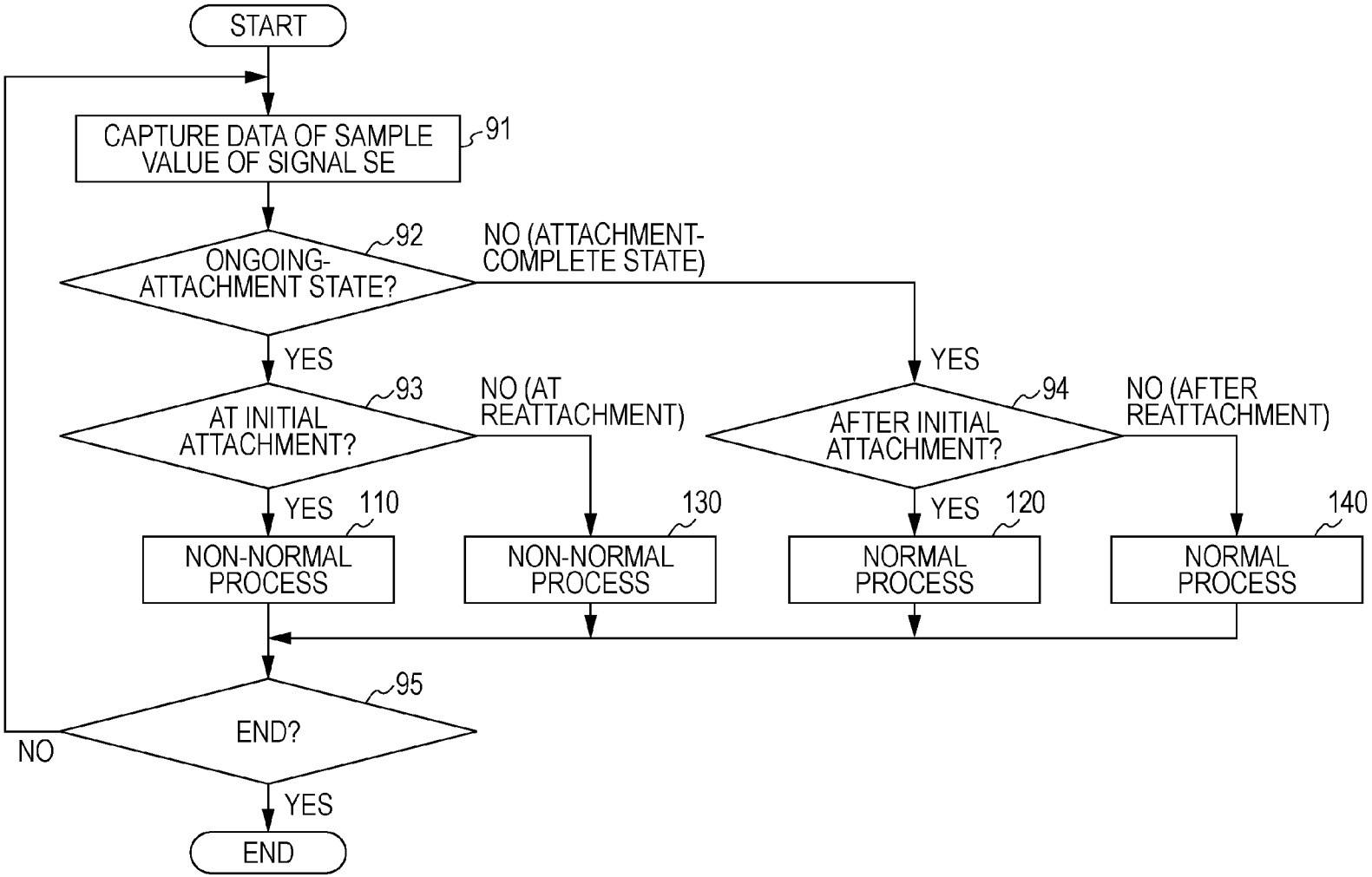
FIG. 6 is a flowchart of a process in an ongoing-attachment state and an attachment-complete state.

FIG. 6 depicts an example of a series of processes regarding the main sensor to be performed by the CPU 16 in the music reproducing unit 10 as the detection controller 43 or the information processing part 41.

With a power supply of the music reproducing unit 10 turned on, the CPU 16 starts processing. At step 91, the CPU 16 first captures data of a sample value of the signal SE.

Next, at step 92, it is determined from the data of the sample value of the signal SE whether the earphone unit 50 is in the ongoing-attachment state.

As depicted in FIG. 5, when the signal SE is at a high level, the earphone unit 50 is in the ongoing-attachment state. When the signal SE is at a low level, the earphone unit 50 is in the attachment-complete state or in a state immediately after the start of operation not even reaching the ongoing-attachment state yet.

However, a state immediately after the start of operation not even reaching the ongoing-attachment state yet, such as in a period from the time t0 to the time t1 in FIG. 5, is also determined as the ongoing-attachment state at initial attachment.

When it is determined at step 92 that the earphone unit 50 is in the ongoing-attachment state, the procedure goes to step 93, where it is determined from the history of changes of the signal SE whether the earphone unit 50 is in the ongoing-attachment state at initial attachment or in the ongoing-attachment state at reattachment.

When it is determined at step 93 that the earphone unit 50 is in the ongoing-attachment state at initial attachment, the procedure goes to step 110, where a non-normal process corresponding to the ongoing-attachment state at initial attachment is performed.

When it is determined at step 93 that the earphone unit 50 is in the ongoing-attachment state at reattachment, the procedure goes to step 130, where a non-normal process corresponding to the ongoing-attachment state at reattachment is performed.

When it is determined at step 92 that the earphone unit 50 is not in the ongoing-attachment state but in the attachment-complete state, the procedure goes to step 94, where it is determined from the history of changes of the signal SE whether the earphone unit 50 is in the attachment-complete state after initial attachment or in the attachment-complete state after reattachment.

When it is determined at step 94 that the earphone unit 50 is in the attachment-complete state after initial attachment, the procedure goes to step 120, where a normal process corresponding to the attachment-complete state after initial attachment is performed.

When it is determined at step 94 that the earphone unit 50 is in the attachment-complete state after reattachment, the procedure goes to step 140, where a normal process corresponding to the attachment-complete state after reattachment is performed.

After the process is performed at step 110, 120, 130, or 140, the procedure goes to step 95, where it is determined whether to end the series of processes.

When the listener performs an end operation or the power supply of the music reproducing unit 10 is turned off, the series of processes ends.

When it is determined that the series of processes has not been ended, the procedure returns to step 91, where data of the next sample value of the signal SE is captured, after which the processes at step 92 and onward are performed.

3-2. Various Processes Regarding Reproduction of Music

FIGS. 7 to 14A and 14B 3-2-1. Sound-Image Localization

FIGS. 7 to 10A and 10B

A first specific example of information processing regarding reproduction of music to be executed by the music reproducing unit 10 in relation to the main sensor is sound-image localization.

When the listener listens to sound, such as music, by using earphones, if right and left audio signals for loudspeakers are supplied to right and left earphones as they are, a sound image is localized in the head of the listener, thereby making the listener feel unnatural.

To get around this, a technique is provided to process audio signals so that a sound image is localized at a virtual sound-source position defined outside the head of the listener.

Figure 7:
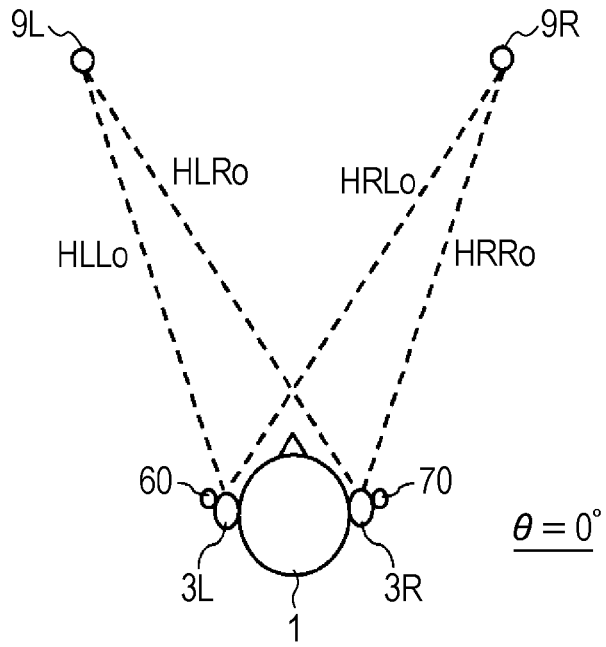
FIG. 7 illustrates an example of sound-image localization.

For example, as depicted in FIG. 7, when a listener 1 faces in a certain direction, left and right audio signals are processed so that a sound image for the left audio signal is localized at a predetermined position 9L on the left front of the listener 1 and a sound image for the right audio signal is localized at a predetermined position 9R on the right front thereof.

HLLo is a transfer function from the position 9L to a left ear 3L of the listener 1, and HLRo is a transfer function from the position 9L to a right ear 3R of the listener 1.

HRLo is a transfer function from the position 9R to the left ear 3L of the listener 1, and HRRo is a transfer function from the position 9R to the right ear 3R of the listener 1.

In FIG. 7, a rotational angle θ from an initial azimuth of the orientation of the listener 1 is 0°.

Figure 8:
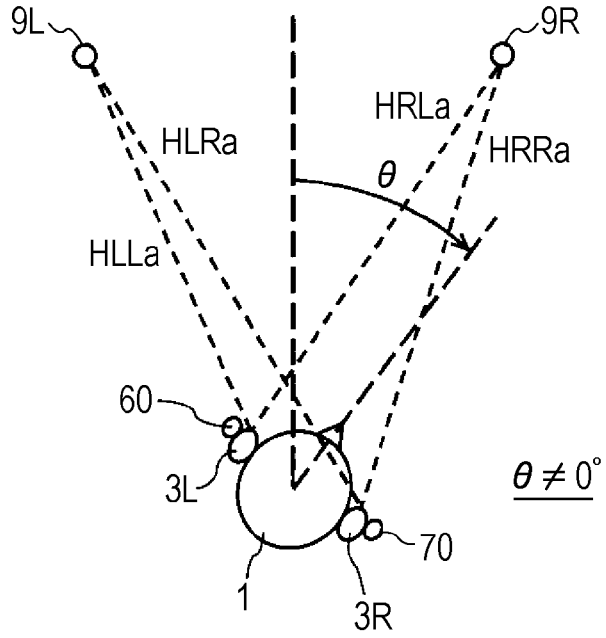
FIG. 8 illustrates an example of sound-image localization.

In FIG. 8, the rotational angle θ is not 0° because the listener 1 rotates his or her head from the state in FIG. 7, and, in spite of this, the sound image of the left audio signal is localized at the same position 9L and the sound image of the right audio signal is localized at the same position 9R.

HLLa is a transfer function from the position 9L to the left ear 3L of the listener 1, and HLRa is a transfer function from the position 9L to the right ear 3R of the listener 1.

HRLa is a transfer function from the position 9R to the left ear 3L of the listener 1, and HRRa is a transfer function from the position 9R to the right ear 3R of the listener 1.

Figure 9:
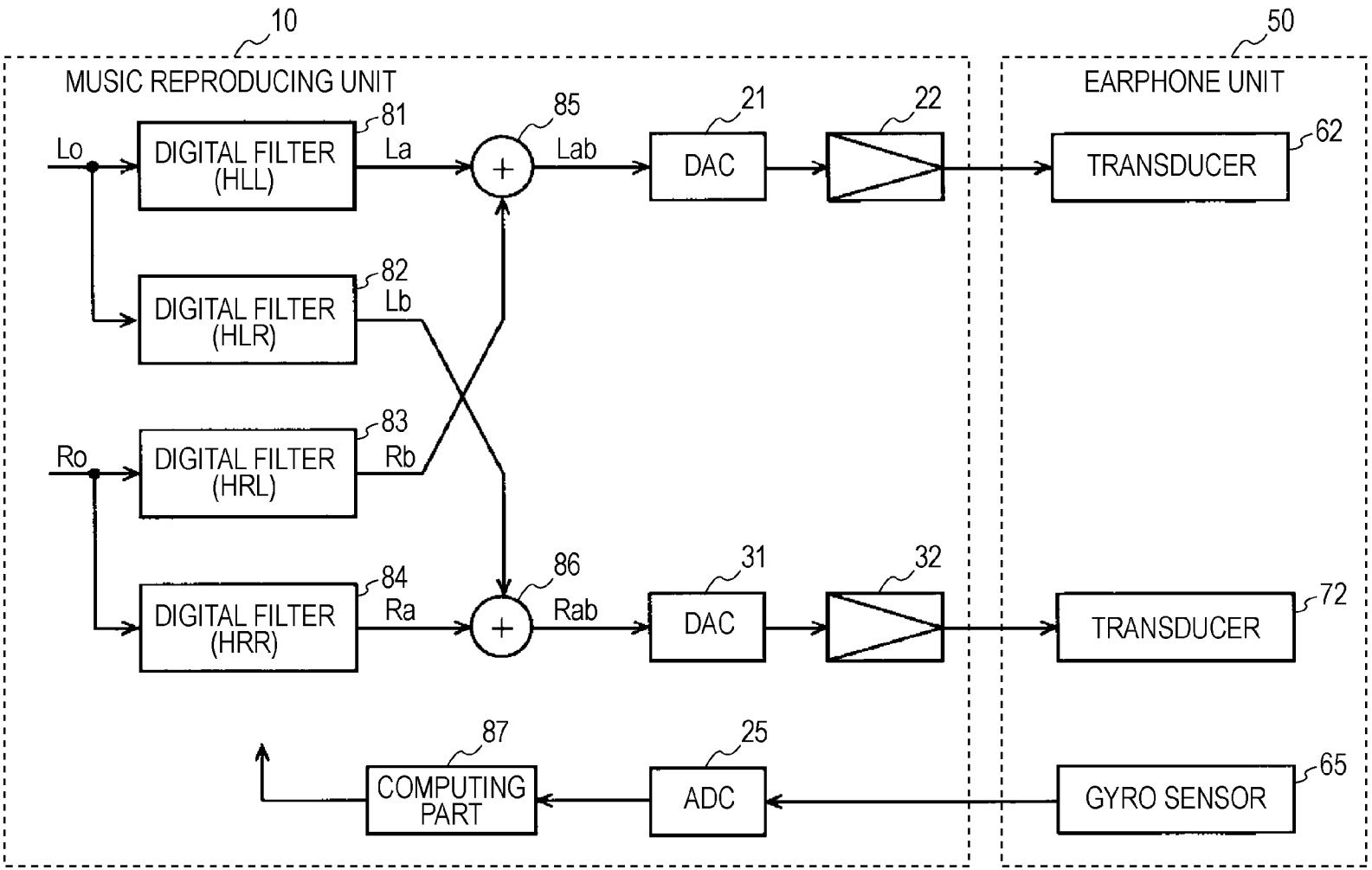
FIG. 9 depicts an exemplary sound-image localization.

FIG. 9 depicts a functional structure of the music reproducing unit 10 when the sound image is localized at a virtual sound-source position defined outside the head of the listener 1 irrespectively of the orientation of the listener 1 as described above.

A left audio signal Lo and a right audio signal Ro represent digital left audio data and digital right audio data, respectively, after compressed data is decompressed.

The left audio signal Lo is supplied to digital filters 81 and 82, and the right audio signal Ro is supplied to digital filters 83 and 84.

The digital filter 81 is a filter that convolves, in a time zone, impulse responses obtained by transforming the transfer function HLL from the position 9L to the left ear 3L of the listener 1.

The digital filter 82 is a filter that convolves, in a time zone, impulse responses obtained by transforming the transfer function HLR from the position 9L to the right ear 3R of the listener 1.

The digital filter 83 is a filter that convolves, in a time zone, impulse responses obtained by transforming the transfer function HRL from the position 9R to the left ear 3L of the listener 1.

The digital filter 84 is a filter that convolves, in a time zone, impulse responses obtained by transforming the transfer function HRR from the position 9R to the right ear 3R of the listener 1.

An adder circuit 85 adds an audio signal La output from the digital filter 81 and an audio signal Rb output from the digital filter 83. An adder circuit 86 adds an audio signal Lb output from the digital filter 82 and an audio signal Ra output from the digital filter 84.

An audio signal Lab output from the adder circuit 85 is converted by the DAC 21 to an analog audio signal. That audio signal after conversion is amplified by the audio amplifier circuit 22 as a left audio signal for supply to the transducer 62.

An audio signal Rab output from the adder circuit 86 is converted by the DAC 31 to an analog audio signal. That audio signal after conversion is amplified by the audio amplifier circuit 32 as a right audio signal for supply to the transducer 72.

On the other hand, an output signal from the gyro sensor 65 is converted by the ADC 25 to digital data indicative an angular velocity.

A computing part 87 integrates that angular velocity to detect a rotation angle of the head of the listener 1, thereby updating the rotation angle θ from an initial azimuth of the orientation of the listener 1.

According to the updated rotation angle θ, filter coefficients of the digital filters 81, 82, 83, and 84 are set so that the transfer functions HLL, HLR, HRL, and HRR correspond to the updated rotation angle θ.

The above-described sound-image localization itself has been disclosed.

In this example of the present invention, for the above-described sound-image localization, in the ongoing-attachment states at initial attachment and at reattachment depicted in FIGS. 5 and 6, as a non-normal process at step 110 and a non-normal process at step 130, respectively, the output signal from the gyro sensor 65 is made ineffective.

Figure 10A:
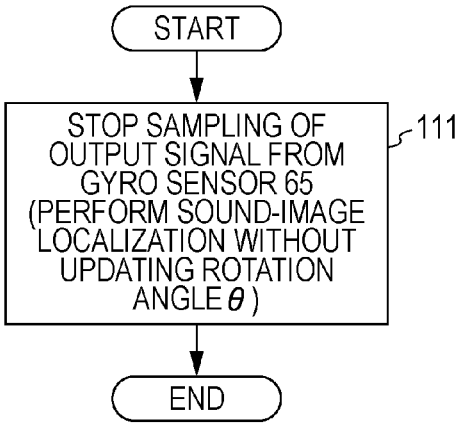
FIGS. 10A and 10B are flowcharts of an example of a process in the ongoing-attachment state and the attachment-complete state to perform sound-image localization.

Specifically, as a non-normal process in this case, as depicted in FIG. 10A, sampling of an output signal by the gyro sensor 65 is stopped at step 111.

That is, in the ongoing-attachment state, without updating the rotation angle θ with the output signal from the gyro sensor 65, sound-image localization is performed with process parameters regarding sound-image localization at the last in the immediately-previous attachment-complete state.

However, in the ongoing-attachment state at initial attachment, since there is no immediately-previous attachment-complete state, sound-image localization is not performed.

The musical piece to be reproduced is selected on the basis of an operation by the listener or the like in a process routine other than a process routine for sound-image localization.

On the other hand, in attachment-complete states after initial attachment and after reattachment, as a normal process at step 120 and a normal process at step 140, respectively, in FIG. 6, sound-image localization is performed while the rotation angle θ is being updated with the output signal from the gyro sensor 65 as described above.

Figure 10B:
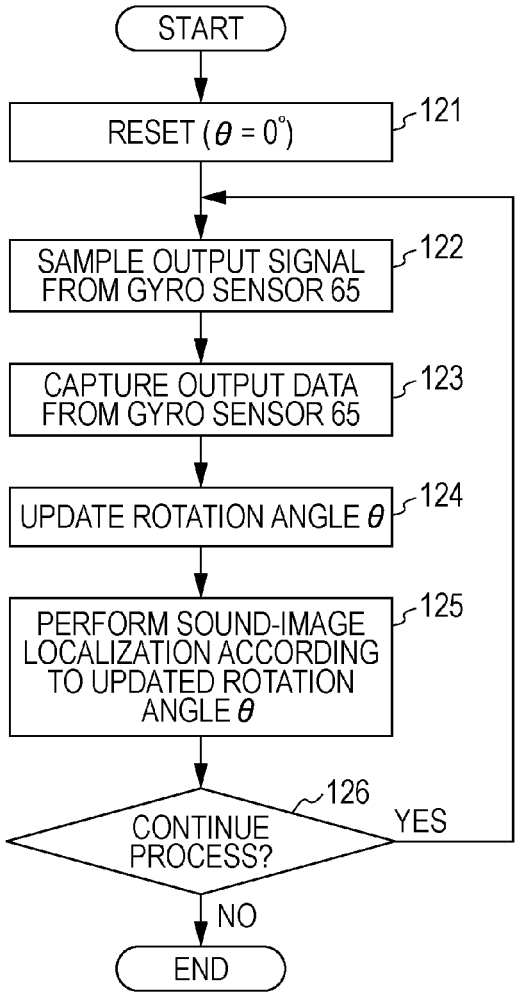

FIG. 10B depicts an example of a series of processes regarding sound-image localization to be performed by the CPU 16 in the music reproducing unit 10 in an attachment-complete state.

On detecting a change from the ongoing-attachment state to the attachment-complete state at the time t4 or the time t14 in FIG. 5, the CPU 16 first resets sound-image localization at step 121. That is, with the rotation angle θ being set at 0°, the orientation of the listener 1 at that time is taken as an initial azimuth.

Next, at step 122, the ADC 25 depicted in FIG. 3 samples the output signal from the gyro sensor 65 for conversion to digital data.

Next, at step 123, the output data from the gyro sensor 65 obtained through conversion is captured. Further at step 124, the computing part 87 updates the rotation angle θ as described above.

Next, at step 125, sound-image localization is performed in accordance with the updated rotation angle θ. Further at step 126, it is determined whether to continue the normal process.

When it is determined to continue the normal process, the procedure returns from step 126 to step 122, repeating the processes at steps 122 to 125.

When a change from an attachment-complete state to the ongoing-attachment state is detected or when the listener performs an end operation, the procedure ends.

3-2-2. Selection of a Musical Piece

Figure 11:
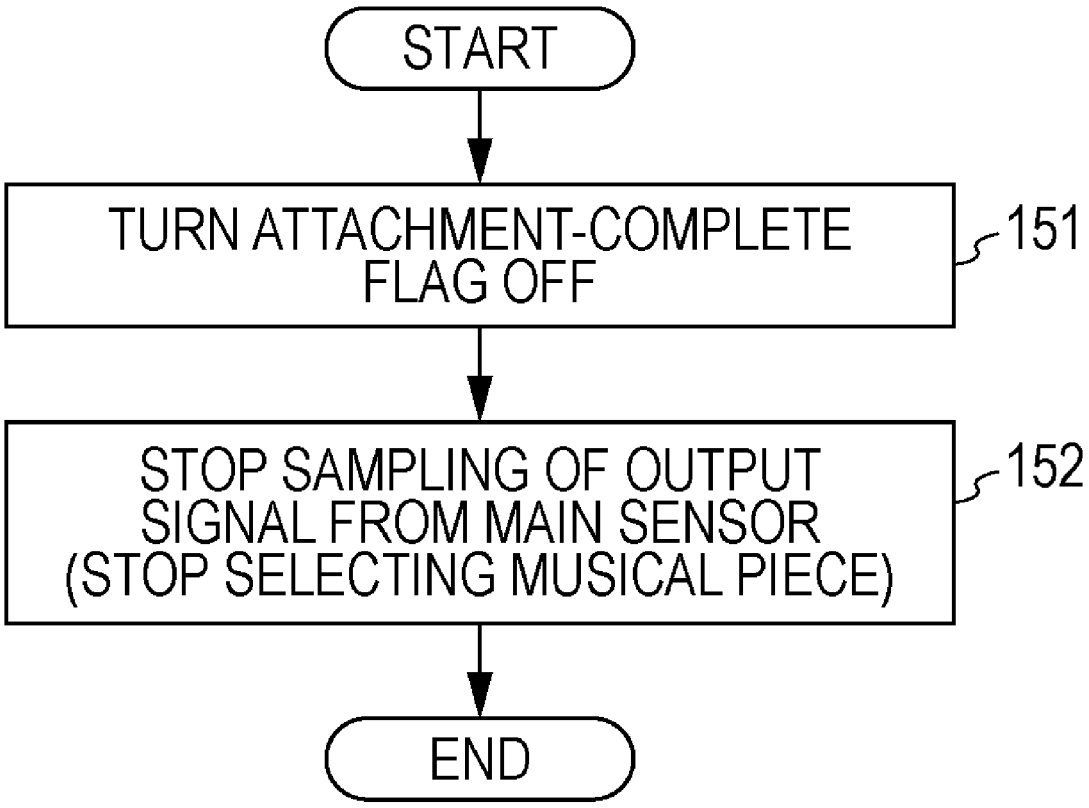
FIG. 11 is a flowchart of an example of a process in an ongoing-attachment state to select a musical piece.
Figure 12:
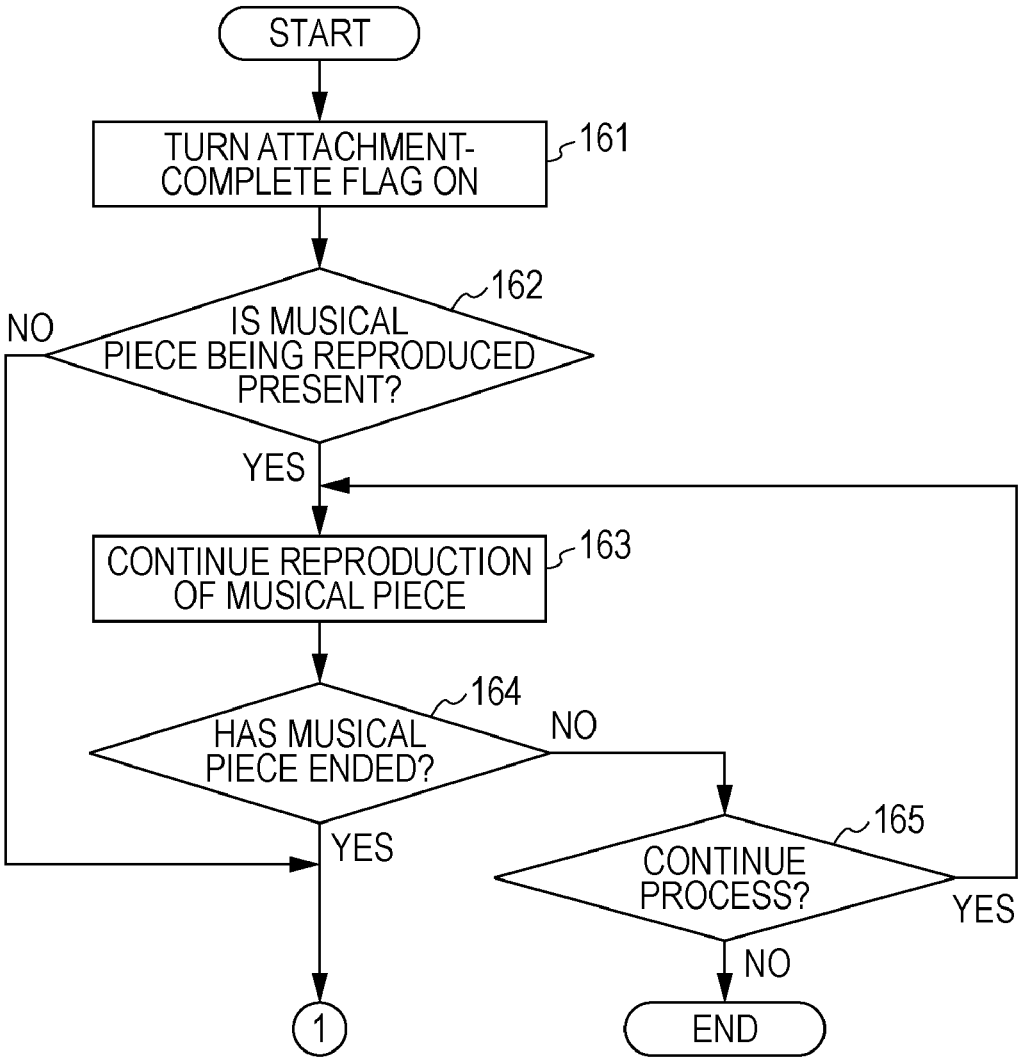
FIG. 12 is a flowchart of a first half of an example of a process in the attachment-complete state to select a musical piece.
Figure 13:
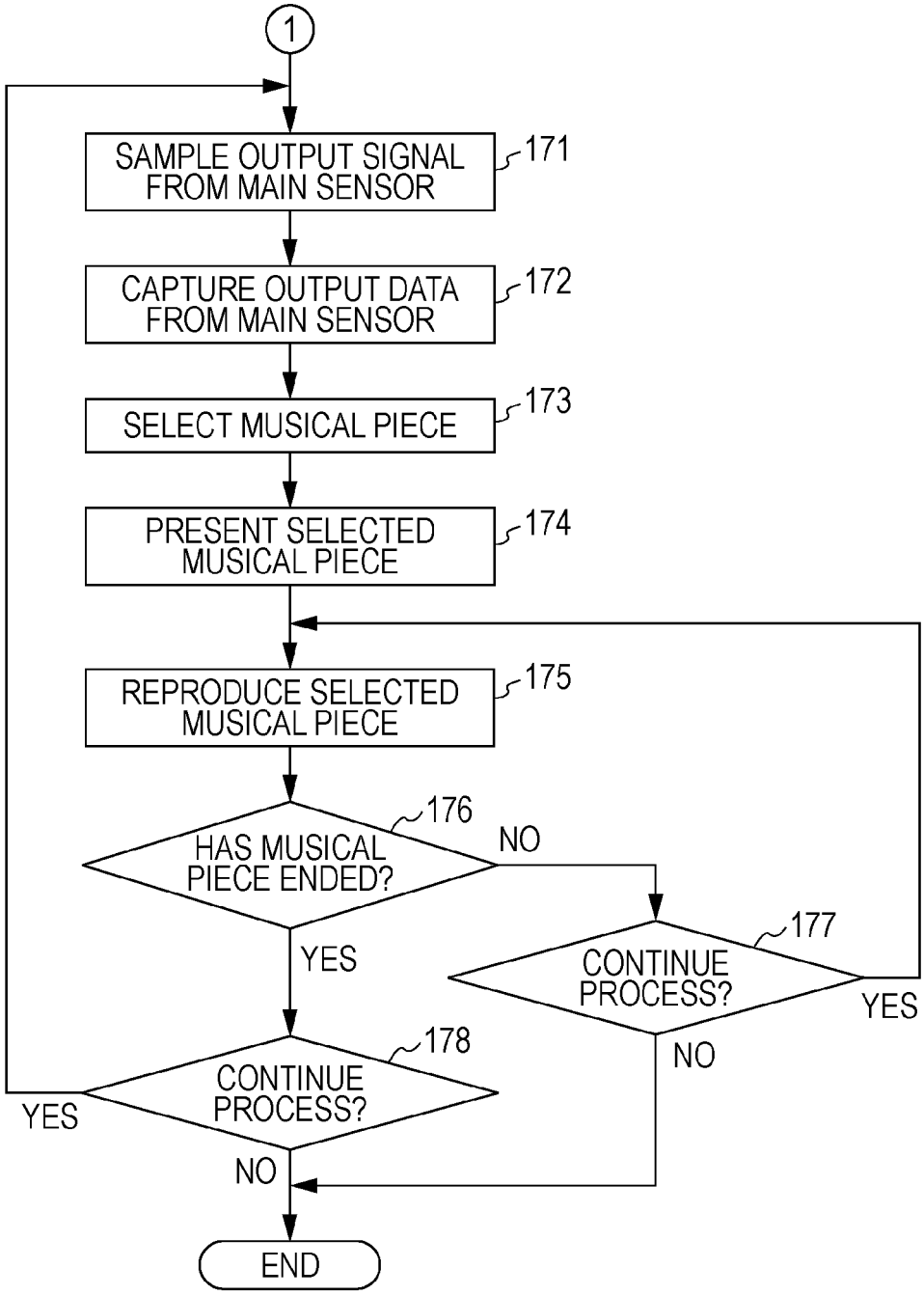
FIG. 13 is a flowchart of a latter half of the example of the process in the attachment-complete state to select a musical piece.

FIGS. 11 to 13

A second specific example of information processing regarding reproduction of music to be executed by the music reproducing unit 10 in relation to the main sensor is selection of a musical piece and presentation of the selected musical piece.

In the music reproducing system 100 in the example depicted in FIGS. 1 to 4, the pulse sensor 51, the sweat sensor 52, or the acceleration sensor 66 is used as a main sensor in this case.

When the pulse sensor 51 or the sweat sensor 52 is used, the mood of the listener at a moment is estimated from, for example, the number of pulses or the amount of sweat of the listener at that moment. Then, a musical piece of a genre or category matching the mood of the listener at that moment is selected for presentation to the listener.

By using both the pulse sensor 51 and the sweat sensor 52, the mood of the listener at that moment can be estimated from output signals from both of the sensors.

When the acceleration sensor 66 is used, for example, from its output signal, the traveling speed of the listener at that moment is detected, and a musical piece in a tempo matching the traveling speed of the listener at that moment is selected for presentation to the listener.

For this purpose, music data recorded in the non-volatile memory 19 is additionally provided with information indicative of the genre, category, tempo, or the like of the musical piece as music associated information.

In this case as well, in ongoing-attachment states at initial attachment and at reattachment depicted in FIGS. 5 and 6, as a non-normal process at step 110 and a non-normal process at step 130, respectively, the output signal from the main sensor is made ineffective.

Specifically, as a non-normal process in this case, as depicted in FIG. 11, an attachment-complete flag is first turned off at step 151. Next, at step 152, sampling of an output signal from the main sensor is stopped.

That is, in the ongoing-attachment state, selection of a musical piece based on the output signal from the main sensor is stopped. For example, as will be described further below, a musical piece selected in the immediately-previous attachment-complete state is reproduced.

However, in the ongoing-attachment state at initial attachment, no immediately-previous attachment-complete state is present. Therefore, no musical piece is reproduced.

On the other hand, in attachment-complete states after initial attachment and after reattachment, as a normal process at step 120 and a normal process at step 140, respectively, in FIG. 6, a process regarding selection of a musical piece is performed.

FIGS. 12 and 13 depict an example of a series of processes regarding selection of a musical piece to be performed by the CPU 16 in the music reproducing unit 10 in an attachment-complete state.

On detecting a change from the ongoing-attachment state to the attachment-complete state at the time t4 or the time t14 in FIG. 5, the CPU 16 first turns on the attachment-complete flag at step 161. Next, at step 162, the CPU 16 determines whether a musical piece being reproduced is present.

When the state becomes the attachment-complete state after initial attachment, such as at the time t4, no previous attachment-complete state is present. Thus, no musical piece is present that has been selected and reproduced in a previous attachment-complete state and is now being reproduced at that time.

By contrast, when the state becomes the attachment-complete state after reattachment, such as at the time t14, a musical piece that has been selected and reproduced in a previous attachment-complete state may be being reproduced even at that time after the immediately-previous ongoing-attachment state.

Even if a musical piece has been selected and reproduced in a previous attachment-complete state, reproduction of that musical piece may have ended in the immediately-previous ongoing-attachment state, and therefore no musical piece being reproduced may be present at that time.

When it is determined at step 162 that a musical piece being reproduced is present, reproduction of that musical piece continues at step 163. Further at step 164, it is determined whether that musical piece has ended.

When it is determined that the musical piece has not ended, the procedure goes from step 164 to step 165, where it is determined whether to continue a normal process.

When it is determined to continue a normal process, the procedure returns from step 165 to step 163 to continue reproduction of the musical piece.

When a change from an attachment-complete state to the ongoing-attachment state is detected or when the listener performs an end operation, the procedure ends.

When it is determined at step 164 that the musical piece has ended or when it is determined at step 162 that no musical piece being reproduced is present, the procedure goes to step 171.

At step 171, the ADC 23, 24, or 26 depicted in FIG. 3 samples an output signal from the pulse sensor 51, the sweat sensor 52, or the acceleration sensor 66 as a main sensor, and then converts the sampled data to digital data.

Next, at step 172, output data from the main sensor after conversion is captured. Further at step 173, the output data from the main sensor is analyzed, and then a musical piece is selected in accordance with the analysis result.

Next, at step 174, the selected musical piece is presented. This presentation is performed by displaying, for example, a title(s) of one or more musical pieces selected, on the display 11.

When a plurality of musical pieces are selected, the listener selects one of these musical pieces, thereby allowing the selected musical piece to be reproduced. When one musical piece is selected, that selected musical piece is reproduced without selection by the listener.

At step 175, the CPU 16 reproduces the selected musical piece. Further at step 176, as with step 164, the CPU 16 determines whether the musical piece has ended.

If the musical piece has not ended, the procedure goes from step 176 to step 177, where it is determined whether to continue a normal process.

When it is determined to continue a normal process, the procedure returns from step 177 to step 175, where reproduction of that musical piece continues.

When a change from an attachment-complete state to the ongoing-attachment state is detected or when the listener performs an end operation, the procedure ends.

When it is determined at step 176 that the musical piece has ended, the procedure goes to step 178, where it is determined whether to continue a normal process.

When it is determined to continue a normal process, the procedure returns from step 178 to step 171, and then the processes at steps 171 to 176 are performed again.

When a change from an attachment-complete state to the ongoing-attachment state is detected or when the listener performs an end operation, the procedure ends.

3-2-3. Control Over a Reproduction State

Figure 14A:
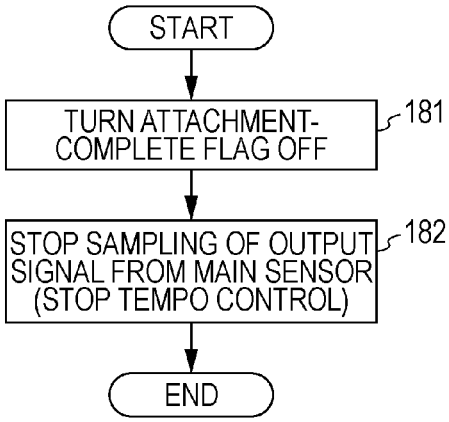
FIG. 14A is a flowchart of part of a process in the ongoing-attachment state to control a reproduction state.
Figure 14B:
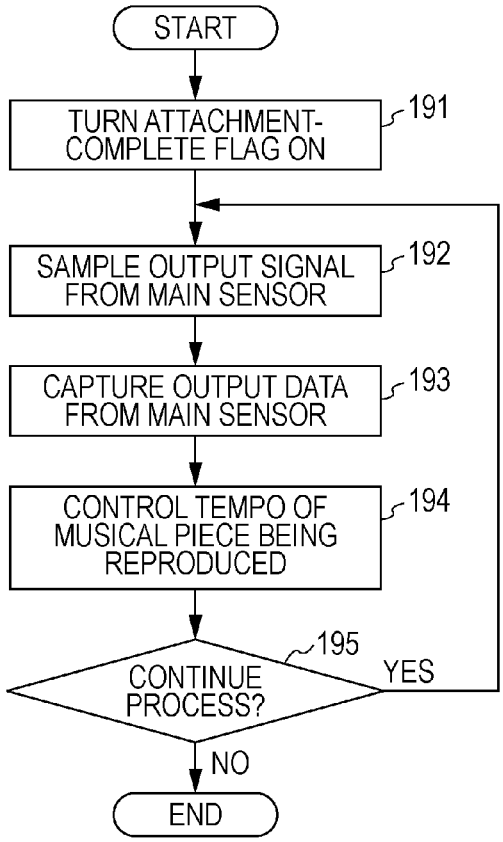
FIG. 14B is also a flowchart of part of a process in the attachment-complete state to control a reproduction state.
Figure 15:
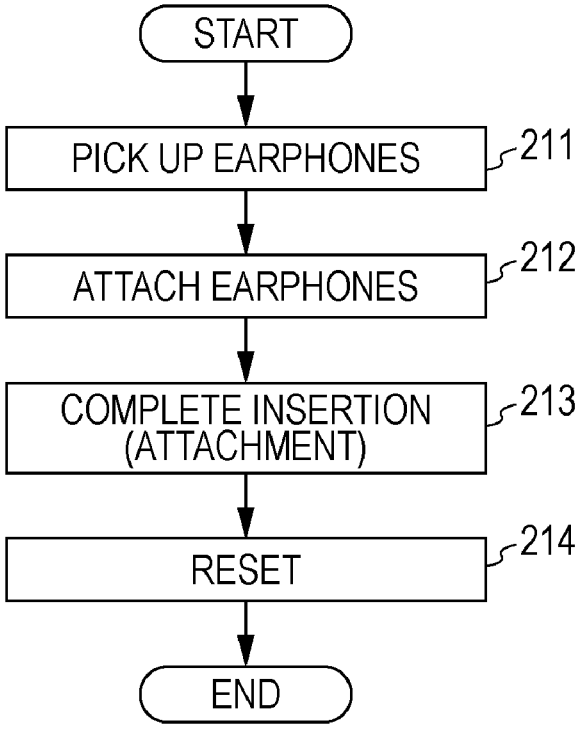
FIG. 15 is a flowchart of a series of operations in the related art to be performed by a listener to attach earphones.
Figure 16:
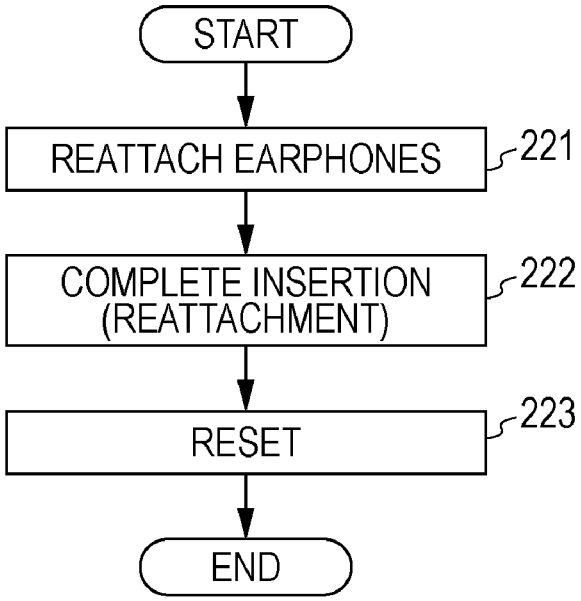
FIG. 16 is a flowchart of a series of operations in the related art when a listener reattaches earphones.

FIGS. 14A and 14B

A third specific example of information processing regarding reproduction of music to be executed by the music reproducing unit 10 in relation to the main sensor is control over a reproduction state, such as a tempo of a musical piece being reproduced.

In the music reproducing system 100 in the example depicted in FIGS. 1 to 4, the pulse sensor 51, the sweat sensor 52, or the acceleration sensor 66 is used as a main sensor in this case.

When the pulse sensor 51 or the sweat sensor 52 is used, for example, the tempo of the musical piece being reproduced is controlled within a predetermined range so that the tempo increases or, conversely, decreases, as the number of pulses or the amount of sweat of the listener increases.

When the acceleration sensor 66 is used, for example, from its output signal, the traveling speed of the listener is detected, and the tempo of the musical piece being reproduced is controlled within a predetermined range so that the tempo increases or, conversely, decreases, as the traveling speed of the listener increases.

In this case as well, in ongoing-attachment states at initial attachment and at reattachment depicted in FIGS. 5 and 6, as a non-normal process at step 110 and a non-normal process at step 130, respectively, the output signal from the main sensor is made ineffective.

Specifically, as a non-normal process in this case, as depicted in FIG. 14A, the attachment-complete flag is first turned off at step 181. Next, at step 182, sampling of an output signal from the main sensor is stopped.

That is, in the ongoing-attachment state, control over the tempo based on the output signal from the main sensor is stopped, and the musical piece being reproduced is reproduced in an original tempo.

The musical piece to be reproduced is selected on the basis of an operation by the listener or the like in a process routine other than a process routine for control over a reproduction state.

On the other hand, in attachment-complete states after initial attachment and after reattachment, as a normal process at step 120 and a normal process at step 140, respectively, in FIG. 6, a process regarding control over a reproduction state is performed.

FIG. 14B depicts an example of a series of processes regarding control over a reproduction state to be performed by the CPU 16 in the music reproducing unit 10 in an attachment-complete state.

On detecting a change from the ongoing-attachment state to the attachment-complete state at the time t4 or the time t14 in FIG. 5, the CPU 16 first turns on the attachment-complete flag at step 191.

Next, at step 192, the ADC 23, 24, or 26 depicted in FIG. 3 samples an output signal from the pulse sensor 51, the sweat sensor 52, or the acceleration sensor 66 as a main sensor, and then converts the sampled data to digital data.

Next, at step 193, output data from the main sensor after conversion is captured. At step 194, the output data from the main sensor is analyzed, and then the tempo of the musical piece being reproduced is controlled in accordance with the analysis result.

Next, at step 195, it is determined whether to continue a normal process. When it is determined to continue the normal process, the procedure returns to step 192, and the processes at steps 192 to 194 are performed again.

When a change from an attachment-complete state to the ongoing-attachment state is detected or when the listener performs an end operation, the procedure ends.

As a reproduction state, a frequency characteristic (frequency component) and sound volume can also be controlled in addition to a tempo.

3-2-4. Others

In each example described above, the output signal from the main sensor is made ineffective in the ongoing-attachment state. Alternatively, the output signal from the main sensor may be suppressed without making the output signal ineffective.

For example, when the tempo of the musical piece being reproduced is controlled in the attachment-complete state, the tempo of the musical piece being reproduced is changed in accordance with the output signal from the main sensor, with a smaller rate of change in the ongoing-attachment state than that in the attachment-complete state.

4. Other Embodiments or Examples

4-1. Regarding the Main Sensor

As a main sensor, at least one motion sensor or biometric sensor can be provided to either one of right and left earphone parts according to information processing regarding reproduction of music.

4-2. Regarding the Attachment-State Detector

The output voltage from the touch sensor 67 or 77 may have the maximum value when the touch sensor is not touched at all with a hand, which is in reverse to the output voltages VL and VR depicted in FIG. 5

Also, as an attachment-state detector, a mechanical switch in which an output voltage of a switch circuit changes between a first value and a second value can be used in place of a touch sensor.

4-3. Regarding the Music Reproducing System

The music reproducing unit is not necessarily dedicated to reproduction of music, and can be a portable telephone terminal, a mobile computer, or a personal computer, as long as it can reproduce music (musical piece) on the basis of music data (musical-piece data).

The transducer unit attached to the listener is not restricted to an earphone unit, and can be a headphone unit.

In this case as well, portions of the headphone unit abutting on left-ear and right-ear portions of the listener can each be provided with an attachment-state detector, such as a touch sensor.

The connection between the music reproducing unit and the transducer unit is not restricted to be wired, as shown in FIG. 1, and can be wireless via Bluetooth (registered trademark) or the like.

The present application contains subject matter related to that disclosed in Japanese Priority Patent Application JP 2008-309270 filed in the Japan Patent Office on Dec. 4, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A music reproducing system comprising:

a music reproducing unit; and a transducer unit connected to the music reproducing unit;

wherein the transducer unit comprises:

a transducer to convert an audio signal to acoustic audio, a main sensor to detect a motion state or a biometric state of a listener to which the transducer unit is attached, and an attachment-state detecting unit that produces an output value that changes between a first value and a second value on the basis of whether the listener makes contact with the transducer unit, and wherein the music reproducing unit comprises:

an information processing part to perform information processing regarding reproduction of music according to an output signal from the main sensor, and a detection controller to determine from the output value from the attachment-state detecting unit whether the transducer unit is in an ongoing-attachment state, in which the transducer unit is being attached or reattached to the listener, or in an attachment-complete state, in which the transducer unit has been attached to the listener, to make the output signal from the main sensor ineffective or suppressing the output signal during a period in which the transducer unit is determined to be in the ongoing-attachment state, and to cancel ineffectiveness or suppression when the transducer unit is determined to be in the attachment-complete state.

2. The music reproducing system according to claim 1, wherein when one of two thresholds between the first value and the second value that is closer to the first value is defined as a first threshold, the other one that is closer to the second value is defined as a second threshold, a direction from the first value to the second value is defined as a first direction, and a direction from the second value to the first value is defined as a second direction, the detection controller determines, as being in the ongoing-attachment state, a period from a time when an output value from the attachment-state detecting means exceeds the second threshold in the first direction to a time when the output value then exceeds the first threshold in the second direction, and determines, as being in an attachment-complete state, a period from a time when the output value from the attachment-state detecting means exceeds the first threshold in the second direction to a time when the output value then exceeds the second threshold in the first direction.

3. The music reproducing system according to claim 2, wherein:

the transducer unit includes right and left transducer parts;

each of the right and left transducer parts includes the transducer and the attachment-state detecting means;

at least one of the right and left transducer parts includes the main sensor; and the detection controller determines, as being in the ongoing-attachment state, a period from a time when the output value from the attachment-state detecting means of either one of the transducer parts exceeds the second threshold in the first direction earlier than the output value of the attachment-state detecting means of another one of the transducer parts to a time when the output value from the attachment-state detecting means of either one of the transducer parts exceeds the first threshold value in the second direction later then the output value of the attachment-state detecting means of another one of the transducer parts.

4. The music reproducing system according to claim 1, wherein:

the main sensor is a gyro sensor; and as the information processing regarding reproduction of music, the information processing part performs a process of localizing a sound image for data of a musical piece to be reproduced at a position defined outside a head of the listener.

5. The music reproducing system according to claim 1, wherein as the information processing regarding reproduction of music, the information processing part selects a musical piece in accordance with the output signal from the main sensor, presents the musical piece as a recommended musical piece, or reproduces the musical piece.

6. The music reproducing system according to claim 1, wherein as the information processing regarding reproduction of music, the information processing part controls a reproduction state of a musical piece being reproduced in accordance with the output signal from the main sensor.

7. An information processing method regarding reproduction of music executed by a music reproducing unit in a music reproducing system, which further includes a transducer unit connected to the music reproducing unit, the transducer unit including a transducer converting an audio signal to acoustic audio, a main sensor detecting a motion state or a biometric state of a listener to which the transducer unit is attached, and attachment-state detecting means for producing an output value that changes between a first value and a second value on the basis of whether the listener makes contact with the transducer unit, the method comprising:

determining from the output value from the attachment-state detecting means whether the transducer unit is in an ongoing-attachment state, in which the transducer unit is being attached or reattached to the listener, or in an attachment-complete state, in which the transducer unit has been attached to the listener;

making an output signal from the main sensor ineffective or suppressing the output signal during a period in which the transducer unit is determined to be in the ongoing-attachment state; and canceling ineffectiveness or suppression of the output signal of the main sensor when the transducer unit is determined to be in the attachment-complete state.

8. A non-transitory computer readable medium on which is stored a program for reproduction of music in a music reproducing system including a music reproducing unit having a computer, and a transducer unit connected to the music reproducing unit, the transducer unit including a transducer converting an audio signal to acoustic audio, a main sensor detecting a motion state or a biometric state of a listener to which the transducer unit is attached, and an attachment-state detecting unit for producing an output value that changes between a first value and a second value on the basis of whether the listener makes contact with the transducer unit, wherein the program causes the computer to:

perform information processing regarding reproduction of music according to an output signal from the main sensor, and determine from the output value from the attachment-state detecting unit whether the transducer unit is in an ongoing-attachment state, in which the transducer unit is being attached or reattached to the listener, or in an attachment-complete state, in which the transducer unit has been attached to the listener, for making the output signal from the main sensor ineffective or suppressing the output signal during a period in which the transducer unit is determined as being in the ongoing-attachment state, and for canceling ineffectiveness or suppression when the transducer unit is determined as being in the attachment-complete state.

9. A music reproducing system comprising:

a music reproducing unit; and a transducer unit connected to the music reproducing unit;

wherein the transducer unit comprises:

a transducer converting an audio signal to acoustic audio, a main sensor to detect a motion state or a biometric state of a listener to which the transducer unit is attached, and an attachment-state detector configured to produce an output value that changes between a first value and a second value on the basis of whether the listener makes contact with the transducer unit, and wherein the music reproducing unit comprises:

an information processing part to perform information processing regarding reproduction of music according to an output signal from the main sensor, and a detection controller to determine from the output value from the attachment-state detector whether the transducer unit is in an ongoing-attachment state, in which the transducer unit is being attached or reattached to the listener, or in an attachment-complete state, in which the transducer unit has been attached to the listener, to make the output signal from the main sensor ineffective or suppressing the output signal during a period in which the transducer unit is determined to be in the ongoing-attachment state, and to cancel ineffectiveness or suppression when the transducer unit is determined to be in the attachment-complete state.

10. A music reproducing apparatus comprising:

a transducer unit comprising:

a transducer to convert an audio signal to acoustic audio, a main sensor to detect a motion state or a biometric state of a listener to which the transducer unit is attached, and an attachment-state detecting unit that produces an output value that changes between a first value and a second value on the basis of whether the listener makes contact with the transducer unit, and wherein the music reproducing unit comprises:

an information processing part to perform information processing regarding reproduction of music according to an output signal from the main sensor, and a detection controller to determine from the output value from the attachment-state detecting unit whether the transducer unit is in an ongoing-attachment state, in which the transducer unit is being attached or reattached to the listener, or in an attachment-complete state, in which the transducer unit has been attached to the listener, to make the output signal from the main sensor ineffective or suppressing the output signal during a period in which the transducer unit is determined to be in the ongoing-attachment state, and to cancel ineffectiveness or suppression when the transducer unit is determined to be in the attachment-complete state.

11. A transducer apparatus comprising:

a transducer to convert an audio signal to acoustic audio, a main sensor to detect a motion state or a biometric state of a listener to which the transducer unit is attached, and an attachment-state detecting unit that produces an output value that changes between a first value and a second value on the basis of whether the listener makes contact with the transducer unit, and wherein the music reproducing unit comprises:

an information processing part to perform information processing regarding reproduction of music according to an output signal from the main sensor, and a detection controller to determine from the output value from the attachment-state detecting unit whether the transducer unit is in an ongoing-attachment state, in which the transducer unit is being attached or reattached to the listener, or in an attachment-complete state, in which the transducer unit has been attached to the listener, to make the output signal from the main sensor ineffective or suppressing the output signal during a period in which the transducer unit is determined to be in the ongoing-attachment state, and to cancel ineffectiveness or suppression when the transducer unit is determined to be in the attachment-complete state.

* * * * *